United States Patent [19]

Rudick et al.

[11] Patent Number: 4,839,107

[45] Date of Patent: Jun. 13, 1989

[54] MICROGRAVITY CARBONATOR SYSTEM

[75] Inventors: Arthur G. Rudick, Marietta; William S. Credle, Jr., Stone Mountain; Richard H. Heenan, Atlanta; Gary V. Paisley, Lilburn, all of Ga.

[73] Assignee: The Coca-Cola Company, Atlanta, Ga.

[21] Appl. No.: 49,521

[22] Filed: May 14, 1987

[51] Int. Cl.[4] ..... B01F 3/04

[52] U.S. Cl. ..... 261/82; 261/DIG. 7

[58] Field of Search ..... 261/82, DIG. 7

[56] References Cited

U.S. PATENT DOCUMENTS

| | | | |
|---|---|---|---|
| 610,062 | 8/1898 | Koenig et al. | 261/DIG. 7 |
| 636,162 | 10/1899 | Murphy | 261/27 |
| 670,796 | 3/1901 | Lynch | 261/82 |
| 1,038,191 | 9/1912 | Paris et al. | 261/23.1 |
| 1,136,004 | 4/1915 | Gross | 261/50.2 |
| 2,460,004 | 1/1949 | Green et al. | 261/82 |
| 2,531,655 | 11/1950 | Thompson | 261/82 |
| 2,604,310 | 7/1952 | Brown | 261/82 |
| 3,109,873 | 11/1963 | Hotchkiss | 261/82 |
| 3,226,099 | 12/1965 | Black et al. | 261/82 |
| 3,605,828 | 9/1971 | Bohm | 261/DIG. 7 |
| 3,756,576 | 9/1973 | Tremolada | 261/82 |
| 4,629,589 | 12/1986 | Gupta et al. | 261/DIG. 7 |

*Primary Examiner*—Tim Miles

*Attorney, Agent, or Firm*—Birch, Stewart, Kolasch & Birch

[57] ABSTRACT

A carbonator system consisting of a meter assembly and two holding tanks which may be used on earth or in the microgravity conditions in outer space. The meter assembly functions as a double acting pump to simultaneously pump separate quantities of water and carbon dioxide to one of two holding tanks which both function as a single acting pump. These holding tanks hold the carbon dioxide and water for a sufficient time and at a sufficient pressure in order to form carbonated water. One of the holding tanks can discharge the formed carbonated water to a dispenser. Once this tank is empty, the other holding tank may begin to dispense carbonated water. The first holding tank may then be refilled with carbon dioxide and water by the action of the meter assembly.

20 Claims, 11 Drawing Sheets

MICROGRAVITY CARBONATOR SYSTEM

BACKGROUND OF THE INVENTION

1. Field of the Invention

The present invention relates to a carbonator system for use either on earth or in the microgravity conditions of outer space. This carbonator system does not require a distinct liquid-gas phase separation in order to operate and includes a meter assembly which supplies carbon dioxide ($CO_2$) gas and water under pressure to a pair of carbonation holding tanks. The carbonation holding tanks retain the water and $CO_2$ gas under a sufficient pressure and for a sufficient time in order to permit the creation of carbonated water. The holding tanks are alternately filled by the meter assembly and are alternately discharged to a dispensing means.

2. Description of the Background Art

Various carbonation systems for carbonating water are known in the art. For instance, U.S. Pat. No. 1,038,191 to Paris et al concerns a machine for carbonating beverages wherein the concept of using multiple tanks is disclosed. As one of these tanks is filled, the other is emptied in the Paris et al arrangement. Another known carbonator is shown in U.S. Pat. No. 2,604,310 to Brown. This patent illustrates the concept of supplying a carbonator tank with a fixed amount of water and a fixed amount of carbon dioxide gas from a positive displacement pump.

The only arrangement known in the art for carbonating water in the microgravity conditions of outer space is disclosed in U.S. Pat. No. 4,629,589, to Gupta et al and entitled "Beverage Dispensing System Suitable for Use in Outer Space", assigned to the same assignee as the present invention.

Accordingly, a need in the art exists for additional forms of carbonator systems which are suitable for use in the microgravity conditions of outer space as well as on earth. Such an arrangement must ensure that only carbonated water and no bursts of carbon dioxide gas are dispensed in the absence of gravity.

SUMMARY OF THE INVENTION

Accordingly, it is the primary object of the present invention to provide a carbonator system which will operate in the zero gravity conditions of outer space as well as on earth.

It is another object of the present invention to provide a carbonator system which does not require a distinct liquid/gas phase separation in order to operate.

It is a further object of the present invention to provide a carbonator system which avoids dispensing bursts of carbon dioxide gas and is capable of continuously dispensing carbonated water.

It is still a further object of the present invention to provide a carbonator system which drives a fixed amount of carbon dioxide into solution to form carbonated water with no free gas remaining.

It is yet another object of the present invention to provide a carbonator system which is suitable for use in outer space, which is highly reliable and requires limited maintenance.

These and other objects of the present invention are fulfilled by providing a carbonator system for producing carbonated water comprising a meter assembly having two chambers with an interconnected piston assembly extending therebetween, said chambers alternatively receiving water and carbon dioxide in order to shift said piston assembly to cause the other of said chambers to discharge water and carbon dioxide contained therein, and holding tank means for receiving said dispensed water and carbon dioxide from the chambers, said holding tank means containing said dispensed water and carbon dioxide for a sufficient time and at a sufficient pressure with sufficient agitation for the water and carbon dioxide to mix to form carbonated water, said holding tank means further selectively dispensing said carbonated water.

This carbonator system may alternatively be characterized as a carbonator system for producing carbonated water comprising double acting pump means for simultaneously pumping separate quantities of water and carbon dioxide which are isolated from one another, and first and second single acting pump means for alternatively receiving said water and carbon dioxide, for holding said water and carbon dioxide with agitation at a pressure and for a time sufficient to form carbonated water, and for alternating pumping the carbonated water to a dispenser, said first single acting pump means being capable of receiving said water and carbon dioxide while said second single acting pump means pumps said carbonated water to said dispenser.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
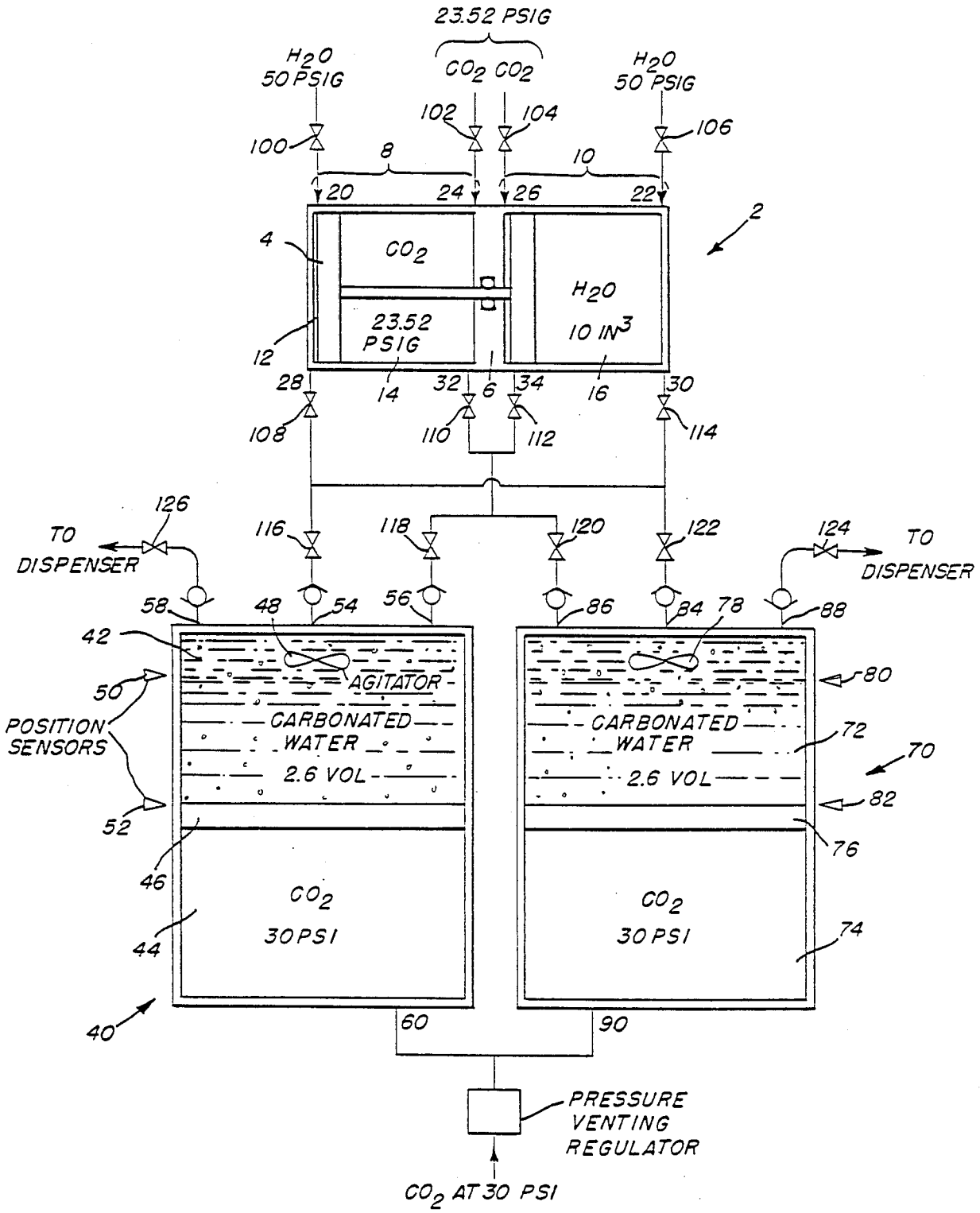
FIG. 1 is a schematic diagram of a subsystem of the carbonator system of the present invention.

Referring in detail to the drawings and with particular reference to FIG. 1, a carbonator system is shown with a meter assembly or double acting pump 2. This meter assembly has a meter piston assembly 4 with two end portions in two separate chambers 8 and 10. These chambers are separated by a fixed wall 6. The end portions of the meter piston assembly 4 divide each chamber 8 and 10 into two sections. Accordingly, chamber 8 is divided into a first section 12 and a second section 14. Chamber 10 is also divided into a first section 16 and a second section 18. Each chamber 8,10 has a water inlet 20,22 and a carbon dioxide inlet 24,26, respectively. As seen in FIG. 1, the arrangement of these inlets results in the first section of each chamber only receives water while the second section of each chamber only receives carbon dioxide. Each chamber 8,10 also has a water outlet 28,30 and a carbon dioxide outlet 32,34, respectively. Thus, the water which enters through inlet 20 into the first section of chamber 8 will be dispensed through water outlet 28. A similar arrangement is found for the first section of chamber 10 wherein the water entering through inlet 22 will be dispensed through outlet 30. This same arrangement is also found for the two carbon dioxide sections of the two chambers 8 and 10.

Two holding tanks or a first and second single acting pump are also provided in the carbonator system of the present invention. In particular holding tank 40 and holding tank 70. Each holding tank is divided into a first and second portion. For holding tank 40, first portion 42 is divided from second portion 44 by a movable membrane or piston 46. In holding tank 70, first portion 72 is divided from second portion 74 by the movable membrane or piston 76. Each holding tank has an agitator 48,78 provided in their respective first portions. Also, each tank has a high level position sensor 50,80 and a low level position sensor 52,82, respectively. The first portion of holding tank 40 receives water through inlet 54 and carbon dioxide through inlet 56. As will be explained in more detail later, the first portion holds the carbon dioxide and water for a sufficient time and at a sufficient pressure in order to form carbonated water. This carbonated water is dispensed through outlet 58. Holding tank 40 also has a carbon dioxide inlet 60 for the second portion 44. The other holding tank 70 also has a water inlet 84 and carbon dioxide inlet 86 in its first portion 72. As with the holding tank 40, holding tank 70 will also hold the carbon dioxide and water for a sufficient time and at a sufficient pressure to form carbonated water. Details of this operation will be explained more fully hereinafter. Once the carbonated water is formed, it is dispensed from the holding tank 70 through outlet 88. This holding tank 70 also has a carbon dioxide inlet 90 for second portion 74.

As seen in FIG. 1, various conduits to the inlets of the meter assembly, between the meter assembly and the holding tanks, and from the outlets of the holding tanks are disclosed. Operation of this conduit arrangement will be explained more fully hereinafter. A plurality of valves are shown in this conduit arrangement. These valves include valve 100 before the water inlet 20, valve 102 before the carbon dioxide inlet 24, valve 104 before the carbon dioxide inlet 26 and valve 106 before the water inlet 22 of the meter assembly. Also disclosed are valves 108, after the water outlet 28, valve 110, after the carbon dioxide outlet 32, valve 112, after the carbon dioxide outlet 34 and valve 114, after the water outlet 30 of the meter assembly. Before holding tank 40, valve 116 is disclosed before the water inlet 54 and valve 118 is disclosed before the carbon dioxide inlet 56. Holding tank 70 also has a valve 120 before the carbon dioxide inlet 86 and valve 122 before the water inlet 84. Finally, valves 124 and 126 are disclosed after the outlets of holding tanks 70, 40, respectively.

Figure 11:
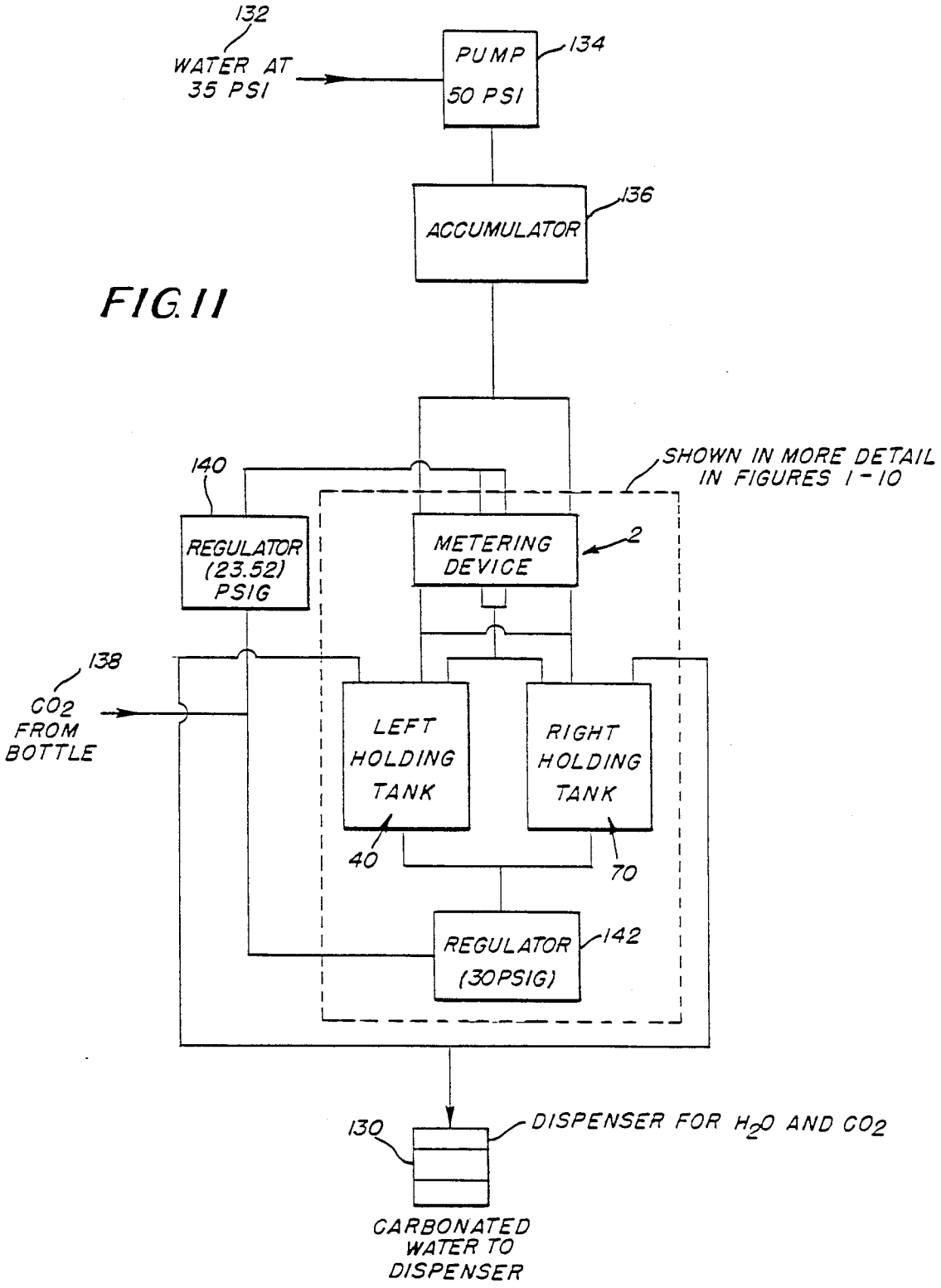
FIG. 11 is a schematic diagram of the carbonator system of the present invention.

The schematic diagram of the subsystem of FIG. 1 is indicated in FIG. 11 and is encircled by dotted lines. In this FIG. 11, the water source for the carbonator system is designated by numeral 132. Water from this source 132 flows to pump 134 where it is released at a pressure of 50 psi to an accumulator 136. Viewing FIG. 11 in conjunction with FIG. 1, the water flows from this accumulator 136 to the water inlet 20 for chamber 8 and the water inlet 22 for chamber 10. Also shown in FIG. 11 is a carbon dioxide source 138. Carbon dioxide flows from this source to a regulator 140 and a regulator 142. From regulator 140, carbon dioxide flows to the $CO_2$ inlet 24 of chamber 8 and the $CO_2$ inlet 26 of chamber 10 of the meter assembly. This carbon dioxide enters the meter assembly at a pressure of 23.52 psig. The carbon dioxide from regulator 142 flows to the second portions 44,74 of holding tanks 40,70 respectively. This carbon dioxide enters the two holding tanks at a pressure of 30 psig. Also shown in FIG. 11 is the dispenser 130 which receives carbonated water from the holding tanks 40,70.

The operation of the carbonator system will now be explained with reference initially to FIG. 1. In this figure, both holding tanks 40,70 are filled with carbonated water. Because of the carbon dioxide gas in the second portions 44,74 is at a pressure of 30 psig, the movable membranes 46,76 are forced upwardly. As 12 psig is the saturation pressure for water at 40° F. carbonated to 2.6 volumes, this pressure of 30 psig is well above the required saturation pressure. Thus, the carbonation is insured of staying in a solution.

Figure 2:
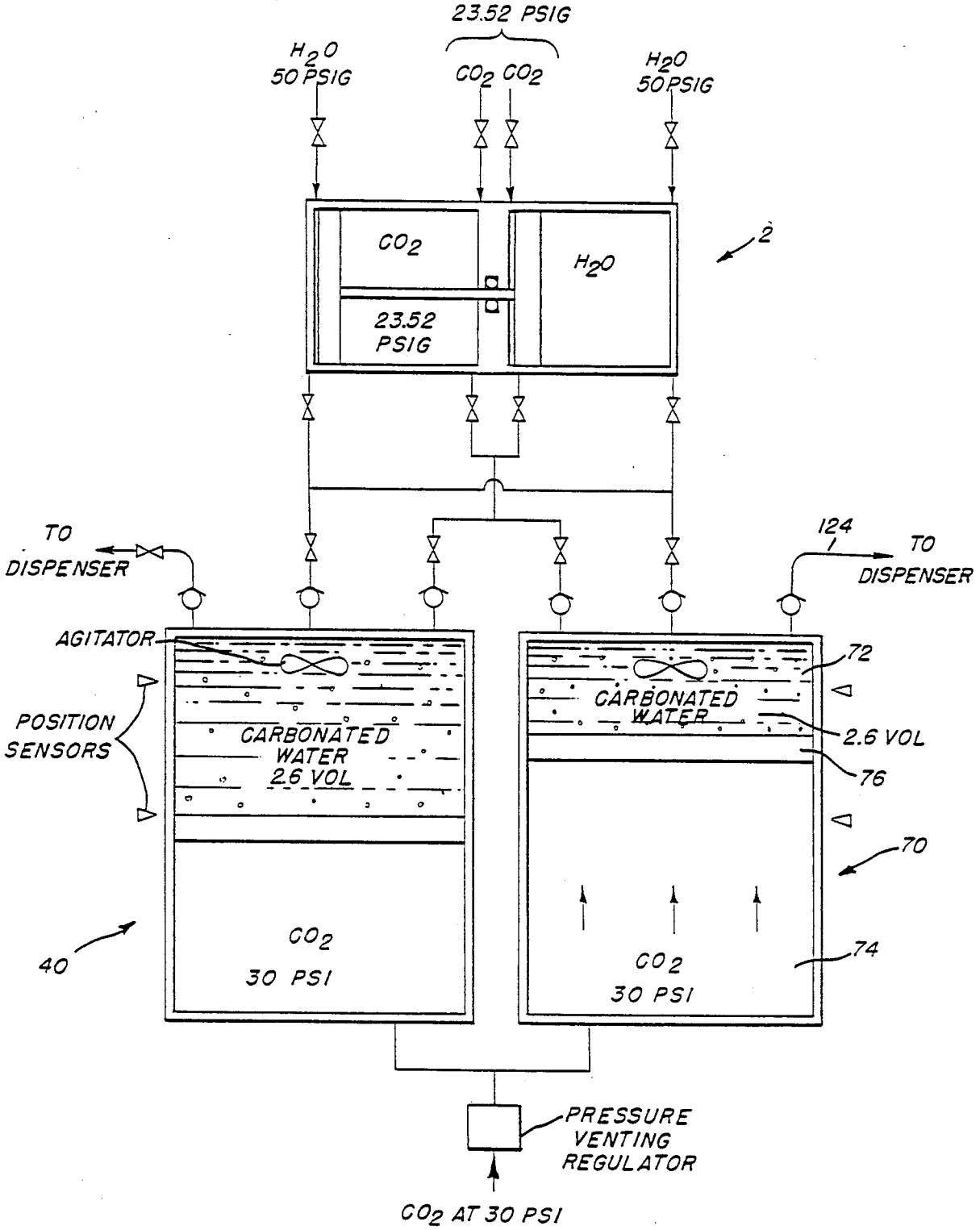
FIG. 2 is a schematic diagram of the subsystem of FIG. 1 showing the carbonator system of the present invention wherein carbonated water is being dispensed from a holding tank.

Referring now to FIG. 2, valve 124 is open to allow the carbonated water to be dispensed to dispenser 130. The carbon dioxide at 30 psig in the second portion 74 of tank 70 provides a force sufficient to push membrane 76 upwardly. This action pushes the water out of the holding tank 70 and in effect, reduces the volume of the first portion 72 of this tank 70.

Figure 3:
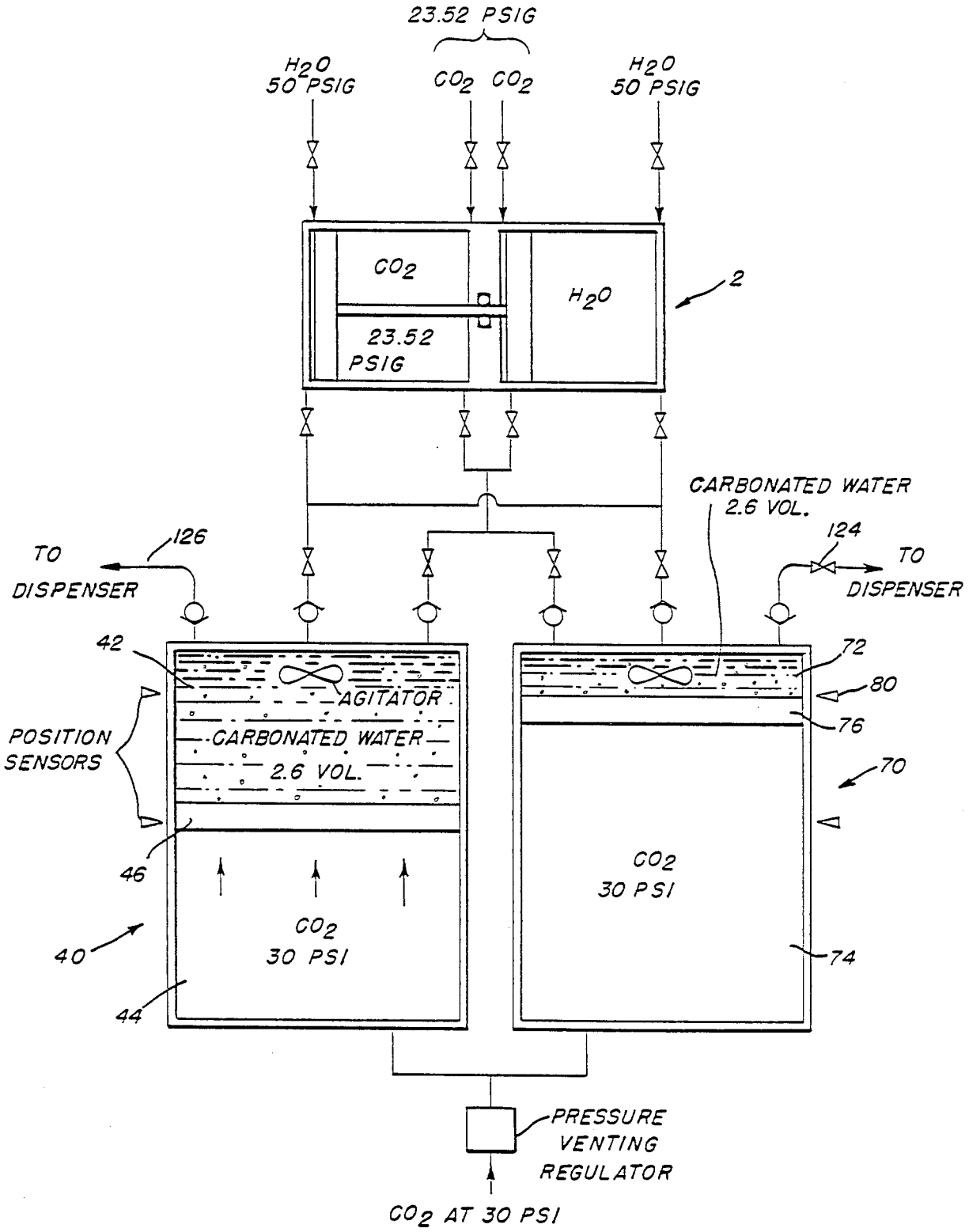
FIG. 3 is a schematic diagram of the subsystem of FIG. 1 showing the carbonator system of the present invention wherein the other of the holding tanks is dispensing carbonated water.

Referring to FIG. 3, the movable membrane 76 of holding tank 70 has reached the high level position sensor 80. This sensor then causes valve 124 to be closed and the holding tank 70 is considered to be "empty". Simultaneously, valve 126 is opened to permit holding tank 40 to dispense the carbonated water held therein. This action permits a continuous flow of carbonated water to the dispenser 130. The pressure of the carbon dioxide in the second portion 44 of holding tank 40 moves movable membrane 46 upwardly and in effect, reduces the volume of the first portion 42 of this tank 40.

Figure 4:
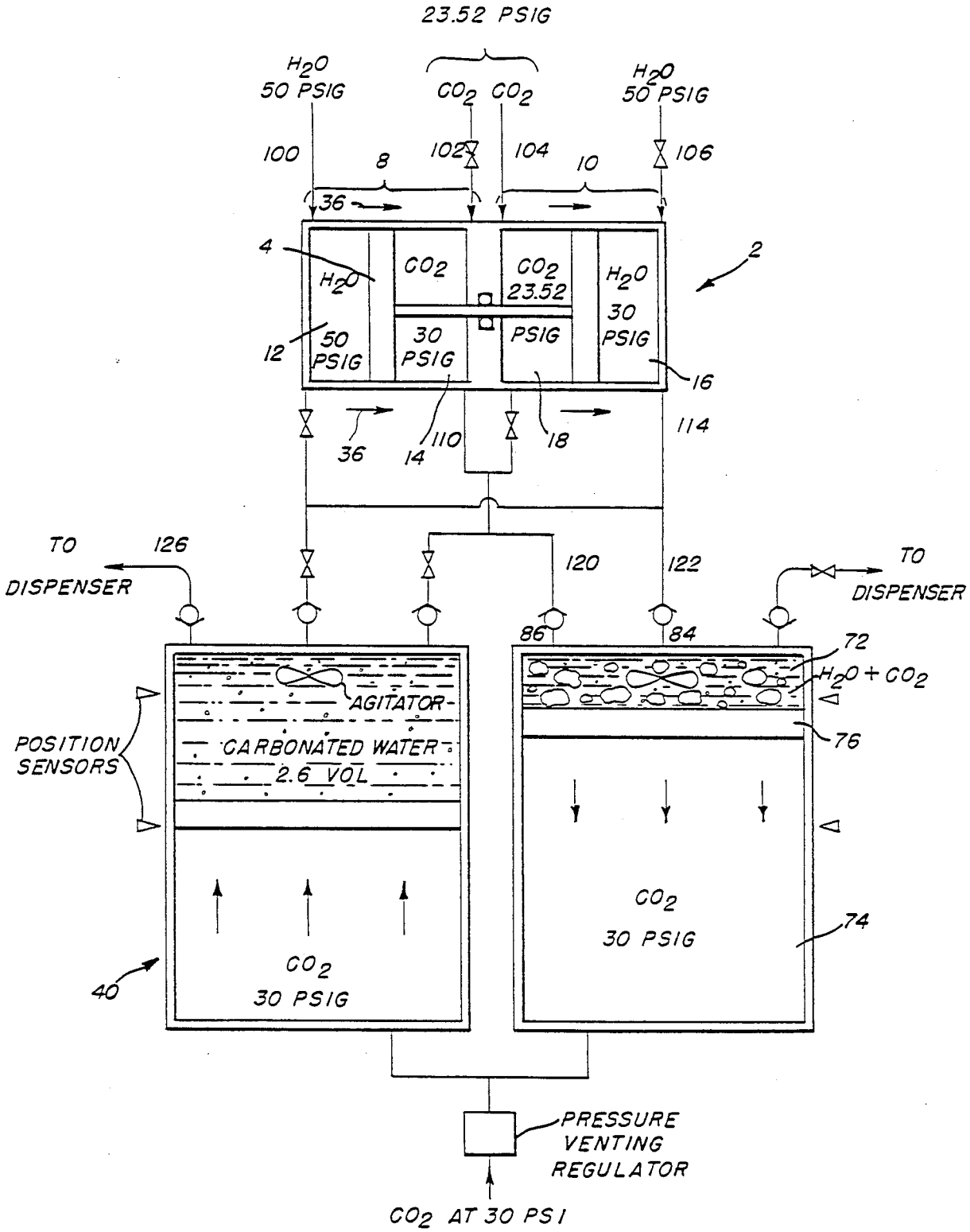
FIGS. 4 and 5 are schematic diagrams of the subsystem of FIG. 1 showing the carbonator system of the present invention wherein water and carbon dioxide are being refilled into a holding tank.
Figure 5:
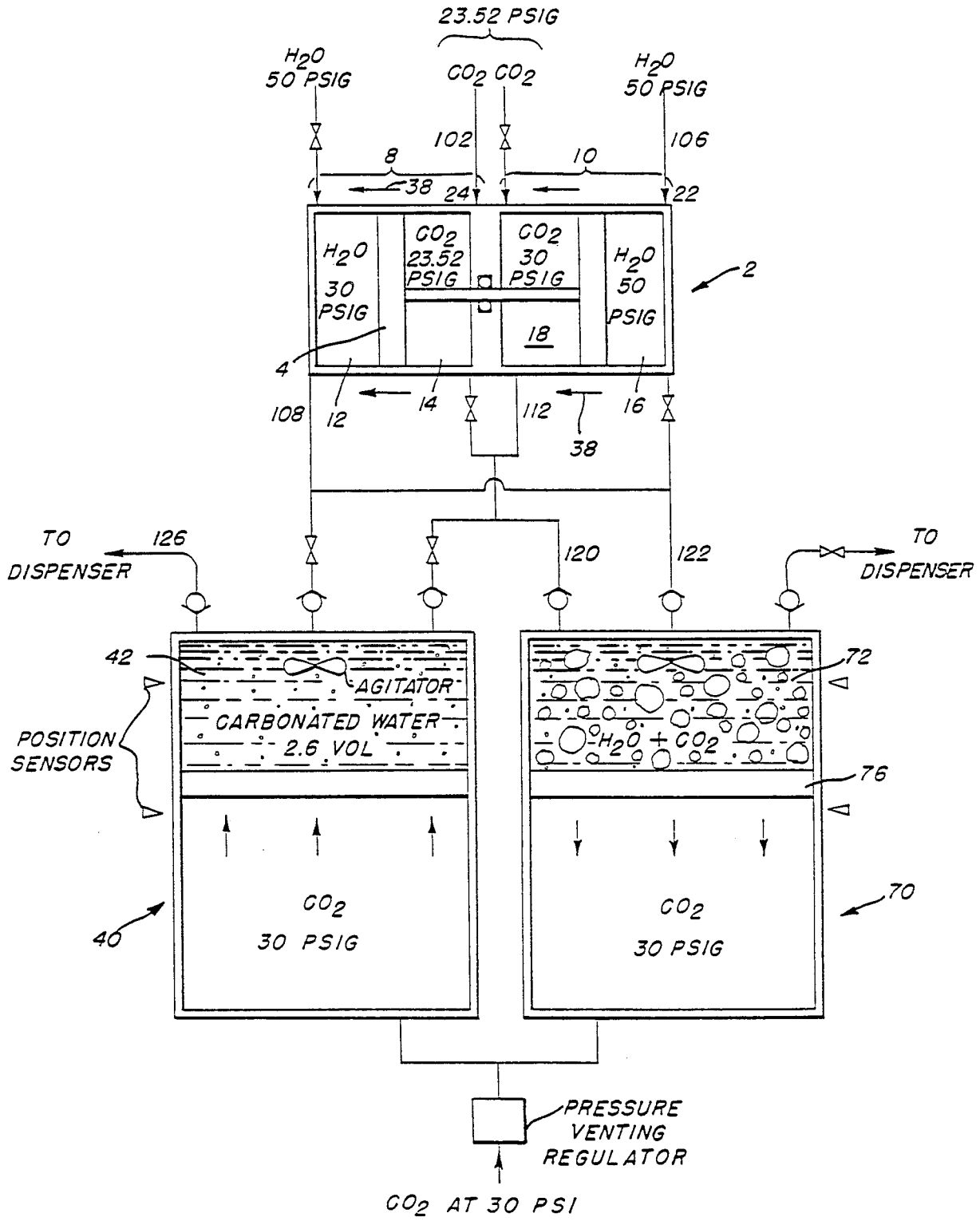
Figure 6:
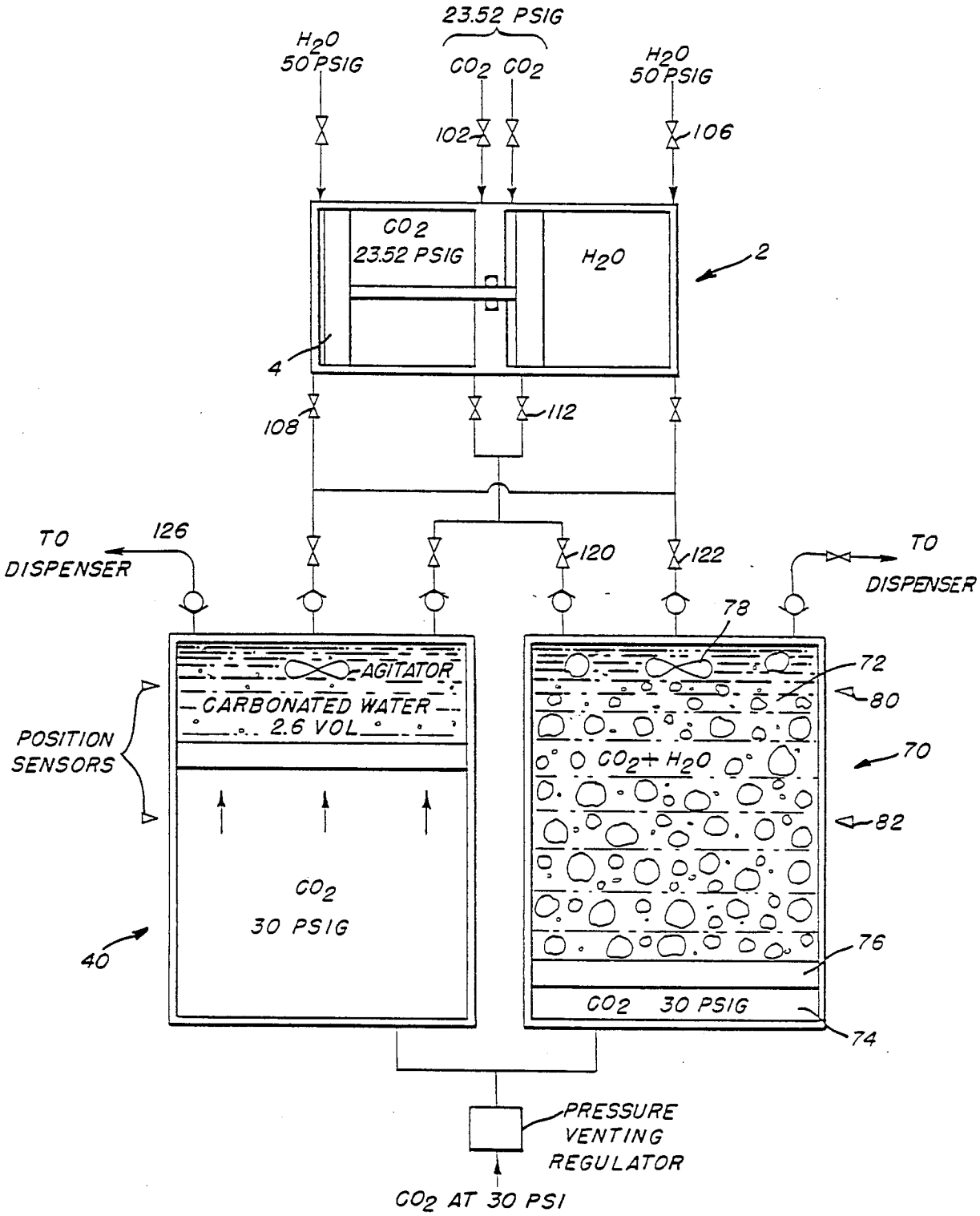
FIGS. 6 through 8 are schematic diagrams of the subsystem of FIG. 1 showing the carbonator system of the present invention wherein water and carbon dioxide are being mixed in the holding tank in order to form carbonated water.

As the carbonated water is dispensed from the holding tank 40, the holding tank 70 must be refilled. This operation is accomplished as shown in FIGS. 4–6. To refill holding tank 70, valve 100 is opened to allow water at 50 psi into the first section 12 of chamber 8. Valve 104 also opens to allow carbon dioxide at 23.52 psig to simultaneously enter the second section 18 of chamber 10. Valves 110 and 120 are also simultaneously opened in order to allow carbon dioxide to move from the second section 14 of chamber 8 to the first portion 72 of the holding tank 70. Moreover, valves 114 and 122 are also opened to simultaneously permit water from first section 16 of chamber 10 to move to the first portion 72 of holding tank 70. The net force on the meter piston assembly 4 causes this piston to move from the left to the right as indicated by arrows 36 in FIG. 4. This movement forces the carbon dioxide and water from the meter assembly (or the double acting pump means) to the holding tank 70. Water enters this tank through inlet 84 while carbon dioxide enters through inlet 86. As carbon dioxide and water enter the first portion 72 of this holding tank 70, the movable membrane (or piston) moves downward.

When the meter piston assembly 4 completes its left to right stroke, valves 100, 104, 110 and 114 are closed. As seen in FIG. 5, valve 106 is open to permit water at 50 psig to enter the first section 16 of chamber 10. Also, valve 102 is simultaneously opened to permit carbon dioxide at 23.52 psig to enter the second section 14 of chamber 8. Simultaneously, valves 108 and 112 are opened to permit water from the first section 12 of chamber 8 and carbon dioxide from the second section 18 of chamber 10 to flow to the first portion 72 of holding tank 70. During this operation, valves 120 and 122 remain open. Thus, more water and carbon dioxide are forced into the first portion 72 of holding tank 70. This action further pushes movable membrane 76 downwardly. While this operation of filling tank 70 is occurring, holding tank 40 continues to dispense the carbonated water held in the first portion 42 as valve 126 has remained open. The water and carbon dioxide entering the meter assembly 2 through inlets 22 and 24 cause the meter piston assembly 4 to move from right to left as indicated by arrow 38.

After a sufficient number of complete meter cycles (for example, five meter cycles), all valves except valve 126 are closed as indicated in FIG. 6. A meter cycle consists of a left to right stroke of the meter piston assembly 4 followed by return movement of this piston assembly to its initial position. Viewing FIG. 6, holding tank 70 is shown with the amount of still water and carbon dioxide contained therein after five strokes. All of the carbon dioxide is initially in the form of free bubbles. The carbon dioxide pressure in the second portion 74 is at 30 psig. This is greater than the saturation pressure for water at 40° F. carbonated to 2.6 volumes. This pressure slowly begins to drive movable membrane 76 upwardly towards the top part of the holding tank. This movement drives the carbon dioxide in the first portion 72 of the holding tank 70 into solution. An agitator 78 is also provided to speed up this process. While the carbon dioxide is being driven into solution, the holding tank 40 continues to dispense the carbonated water.

Figure 7:
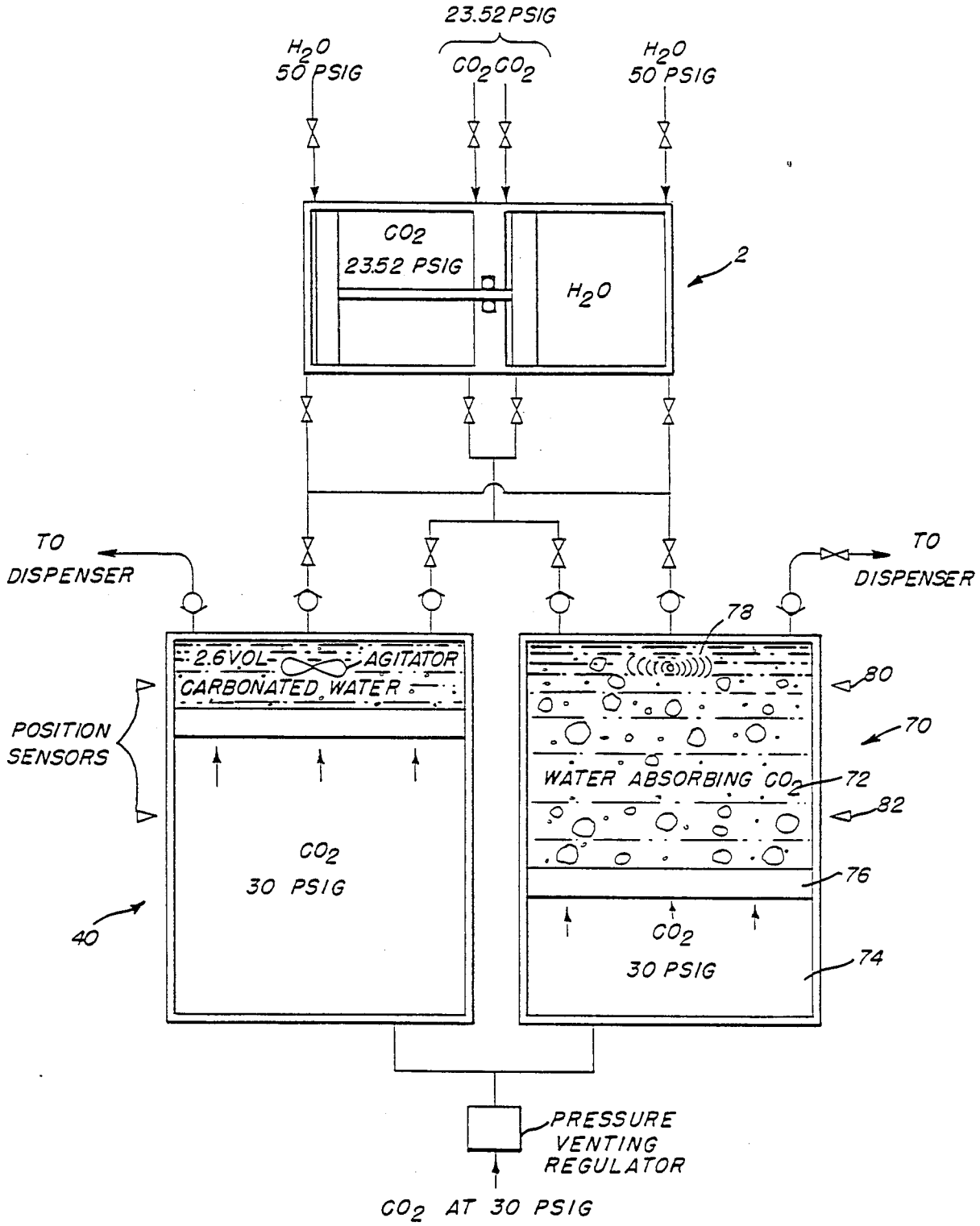

Referring now to FIG. 7, more and more carbon dioxide is driven into solution in the first portion 72 of holding tank 70. The movable membrane 76 continues to move upwardly due to the pressure of the carbon dioxide in the second portion 74.

Figure 8:
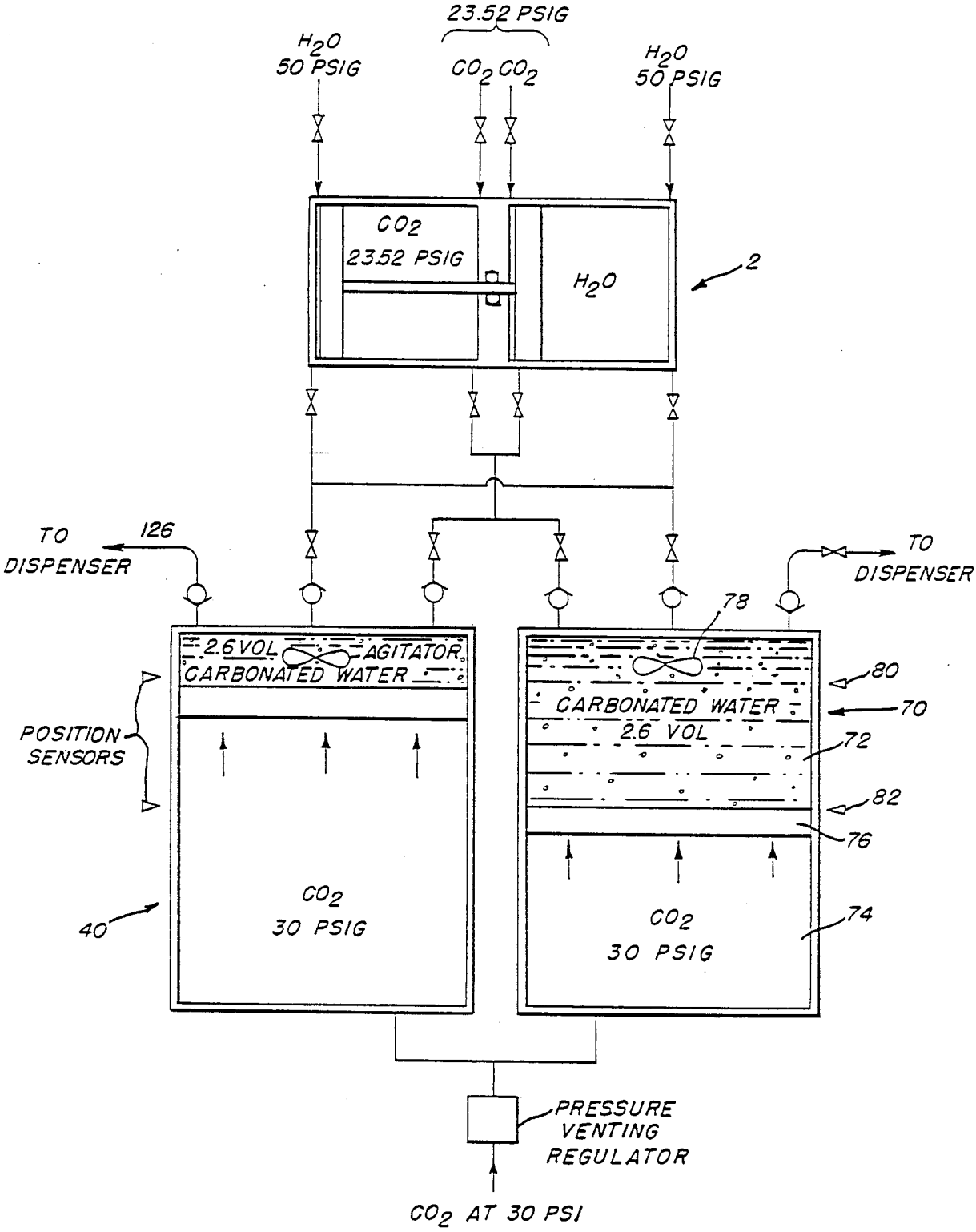

When the movable membrane 76 reaches the low position sensor 82, as seen in FIG. 8, all of the free $CO_2$ has been driven into solution. The water in holding tank 70 is fully carbonated and ready to be dispensed as soon as holding tank 40 is empty. It is contemplated that a timer instead of a position sensor could be used to determine when the carbon dioxide gas has been driven into solution.

Figure 9:
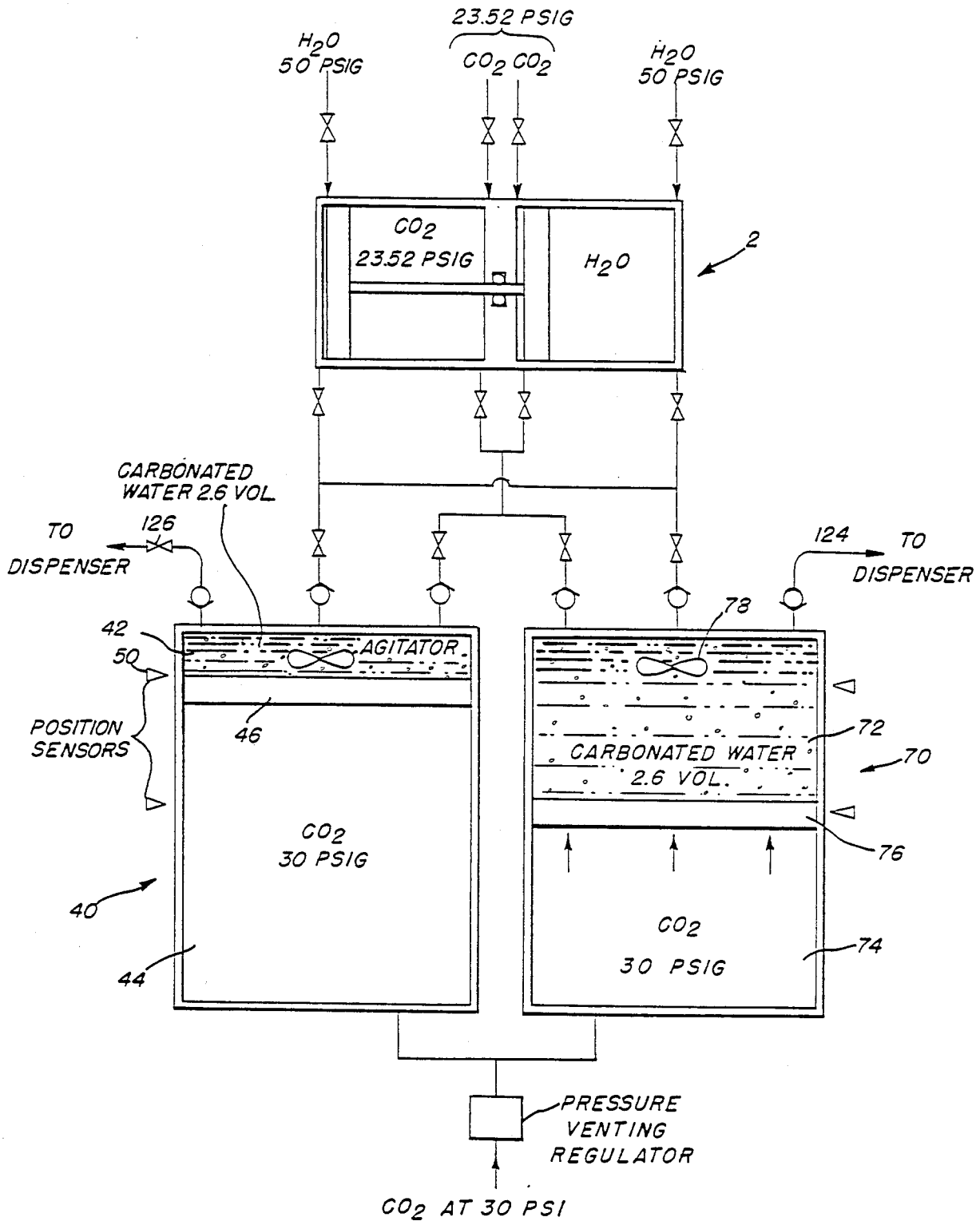
FIG. 9 is a schematic diagram of the subsystem of FIG. 1 showing the carbonator system of the present invention wherein dispensing of carbonated water from the other of the holding tanks is terminated and carbonated water has begun to be dispensed from the first holding tank.

Referring now to FIG. 9, holding tank 40 is "empty" and valve 126 is closed as the movable membrane 46 has reached the high level position sensor 50. Valve 124 may be immediately opened to permit the carbonated water in the first portion 72 of tank 70 to be pumped to the dispenser 130 for continuous flow of carbonated water. The pressure of the carbon dioxide in the second portion 74 of holding tank 70 causes the movable membrane 76 to move upwardly in order to discharge the carbonated water held in tank 70.

Figure 10:
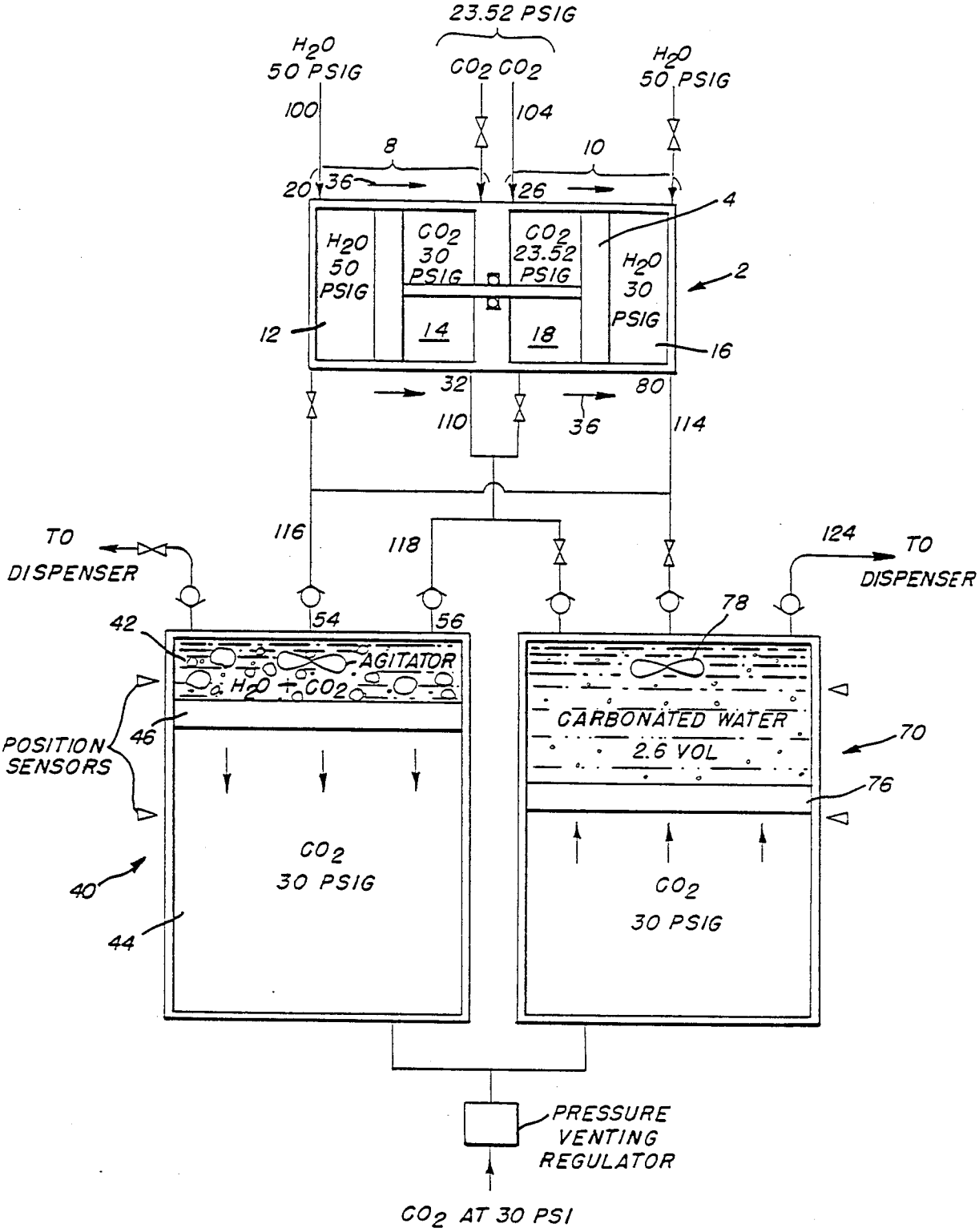
FIG. 10 is a schematic diagram of the subsystem of FIG. 1 showing the carbonator system of the present invention wherein the other of the holding tanks begins refilling.

As carbonated water is dispensed from holding tank 70, holding tank 40 is refilled as indicated in FIG. 10. Valves 100, 104, 110, 114, 116, and 118 are opened. As water enters the first section 12 of chamber 8 through water inlet 20 and as carbon dioxide enters the second section 18 of chamber 10 through carbon dioxide inlet 26, the meter piston assembly 4 is forced in the direction of arrows 36. This movement forces water from the first section 16 of chamber 10 through the water inlet 54 of the holding tank 40. Also, carbon dioxide from the second section 14 of chamber 8 is forced through the carbon dioxide inlet 56 of the holding tank 40. As water and carbon dioxide enter the first portion 42 of the holding tank 40, the movable piston 46 is forced downwardly. The steps for filling the holding tank 40 are substantially similar to that as indicated for filling the holding tank 70 in FIGS. 4–5. After the desired amount of carbon dioxide and water have been introduced into the first portion 42, they are held in this first portion 42 of holding tank 40 for a sufficient time and at a sufficient pressure with sufficient agitation to make carbonated water. This feature is similar to the arrangement shown for holding tank 70 in FIGS. 6–8. Thus, carbonated water may be formed in either tank 70 or 40 as the other of the holding tanks is dispensing the already formed carbonated water. This arrangement permits continuous dispensing of the carbonated water.

As a sample set of calculations to illustrate how the carbonator arrangement may operate, the following are offered:

Desired level of carbonation: 2.6 vol

Water Temperature (throughout the entire system): 40° F.

Pressure at saturation: 12 psig

Volume of water sent to the holding tank from the metering device during one stroke (Note: there are two strokes to a cycle): 10 $in^3$ Volume of $CO_2$ sent to the holding tank from the metering device during one stroke: 10 $in^3$ at 23.52 psig which equal 26 $in^3$ at 0 psig Volume of the holding tank between the position sensors: 100 $in^3$ Cycles required to fill the holding tank: 5

It should be understood that the carbonator system of the present invention may be utilized in the microgravity conditions of outer space as well as on earth. Also, it is contemplated that only one holding tank or more than two holding tanks may be used in the carbonator system. While this carbonator system has been disclosed for dispensing carbonated water, any other known solution may be handled by this system. Furthermore, as this system is contemplated for use in outer space, it should be noted that any reference to upwardly or downwardly contained within the specification has merely been made with reference to the attached drawings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A carbonator system for producing carbonated water comprising:

a meter assembly having two chambers with an interconnected piston assembly extending therebetween, said chambers alternatively receiving water and carbon dioxide in order to shift said piston assembly to cause the other of said chambers to discharge water and carbon dioxide contained therein;

holding tank means for receiving said dispensed water and carbon dioxide from the chambers, said holding tank means containing said dispensed water and carbon dioxide for a sufficient time and at a sufficient pressure for the water and carbon dioxide to mix to form carbonated water, said holding tank means further being capable of selectively dispensing said carbonated water; and a movable membrane located within said holding tank means and forming a first and second portion in said holding tank means, each portion having a variable volume due to movement of the membrane, said first portion receiving said water and carbon dioxide dispensed from the meter assembly, said second portion receiving carbon dioxide from a carbon dioxide source, said holding tank means being sealed from the meter assembly after a predetermined amount of water and carbon dioxide is dispensed whereafter said movable membrane moves in a manner to cause the volume of said first portion to be reduced, said reduction in volume in the first portion increasing pressure in the first portion to cause the sufficient pressure to be reached for mixing the water and carbon dioxide to form carbonated water.

2. The carbonator system as recited in claim 1 wherein said holding tank means contains an agitator to assist in mixing the water and carbon dioxide to form carbonated water.

3. The carbonator system as recited in claim 1 wherein said holding tank means dispenses said carbonated water to a dispenser.

4. The carbonator system as recited in claim 1, wherein said system is for use in the microgravity conditions of outer space.

5. The carbonator system as recited in claim 1, wherein said holding tank means includes two holding tanks which alternatively receive the dispensed water and carbon dioxide and which alternatively dispense the carbonated water, said two holding tanks each having a movable membrane forming first and second portions.

6. The carbonator system as recited in claim 5, wherein said two chambers of said meter assembly each have two sections formed by said piston assembly, a first section of each of said chambers alternatively receiving water at a first pressure from a water source, said second section of each of said chambers alternatively receiving carbon dioxide at a second pressure from the carbon dioxide source, said first pressure being greater than said second pressure with the difference between the first and second pressures being sufficient to cause said piston assembly to shift.

7. The carbonator system as recited in claim 6, wherein said first section of one of said chambers dispenses water to a selected one of the two holding tanks while said second section of the other of said chambers dispenses carbon dioxide to the selected one of the two holding tanks whereafter the second section of the one of said chambers dispenses carbon dioxide to the selected one of the two holding tanks while the first section of the other of said chambers dispenses water to the selected one of the two holding tanks.

8. The carbonator system as recited in claim 7, wherein the selected one of the two holding tanks alternates between the two holding tanks and wherein as said dispensed water and carbon dioxide is received by the selected one of the two holding tanks, the movable membrane of the selected holding tank moves so as to reduce the volume of the second portion of said selected one of the two holding tanks.

9. The carbonator system as recited in claim 8, wherein said system is for use in the microgravity conditions of outer space.

10. A carbonator system for producing carbonated water comprising:

double acting pump means for simultaneously pumping separate quantities of water and carbon dioxide which are isolated from one another; and first and second single acting pump means for alternatively receiving said water and carbon dioxide, for holding said water and carbon dioxide with sufficient agitation at a pressure and for a time sufficient to form carbonated water, and for alternatively pumping the carbonated water to a dispenser, said first single acting pump means being capable of receiving said water and carbon dioxide while said second single acting pump means pumps said carbonated water to said dispenser.

11. The carbonator system as recited in claim 10, wherein said system is for use in the microgravity conditions of outer space.

12. The carbonator system as recited in claim 10, wherein said water is received in said double acting pump means at a first pressure and said carbon dioxide is received in said double acting pump means at a second pressure, said first pressure being greater than said second pressure with the difference in pressure being sufficient to drive said double acting pump means.

13. A carbonator system for producing carbonated water comprising:

a meter assembly having two chambers with an interconnected piston assembly extending therebetween, said chambers alternatively receiving water and carbon dioxide in order to shift said piston assembly to cause the other of said chambers to discharge water and carbon dioxide contained therein; and holding tank means for receiving said dispensed water and carbon dioxide from the chambers, said holding tank means containing said dispensed water and carbon dioxide for a sufficient time and at a sufficient pressure for the water and carbon dioxide to mix to form carbonated water, said holding tank means further being capable of selectively dispensing said carbonated water, said holding tank means including two holding tanks which alternatively receive the dispensed water and carbon dioxide and alternatively dispense the carbonated water.

14. The carbonator system as recited in claim 13 wherein said holding tank means contains an agitator to assist in mixing the water and carbon dioxide to form carbonated water.

15. The carbonator system as recited in claim 13 wherein said holding tank means dispenses said carbonated water to a dispenser.

16. The carbonator system as recited in claim 13 wherein said system is for use in the microgravity conditions of outer space.

17. A carbonator system for producing carbonated water comprising:

a meter assembly having two chambers with an interconnected piston assembly extending therebetween, said chambers alternatively receiving water and carbon dioxide in order to shift said piston assembly to cause the other of said chambers to discharge water and carbon dioxide contained therein, said two chambers each having two sections formed by said piston assembly, a first section of each of said chambers alternatively receiving water at a first pressure from a water source, said second section of each of said chambers alternatively receiving carbon dioxide at a second pressure from the carbon dioxide source, said first pressure being greater than said second pressure with the difference between the first and second pressures being sufficient to cause said piston assembly to shift; and holding tank means for receiving said dispensed water and carbon dioxide from the chambers, said holding tank means containing said dispensed water and carbon dioxide for a sufficient time and at a sufficient pressure for the water and carbon dioxide to mix to form carbonated water, said holding tank means further being capable of selectively dispensing said carbonated water.

18. The carbonator system as recited in claim 17 wherein said holding tank means contains an agitator to assist in mixing the water and carbon dioxide to form carbonated water.

19. The carbonator system as recited in claim 17 wherein said holding tank means dispenses said carbonated water to a dispenser.

20. The carbonator system as recited in claim 17 wherein said system is for use in the microgravity conditions of outer space.

* * * * *